US005287581A

United States Patent [19]

Lo

[11] Patent Number: 5,287,581

[45] Date of Patent: Feb. 22, 1994

[54] CLEANING DEVICE HAVING AT LEAST ONE ROTATING CYLINDRICAL SPONGE

[76] Inventor: Kam C. Lo, 934 Everett St. #6, Los Angeles, Calif. 90026

[21] Appl. No.: 970,183

[22] Filed: Nov. 2, 1992

[51] Int. Cl.[5] ..... A47L 11/292

[52] U.S. Cl. ..... 15/52; 15/98; 15/230; 15/230.14

[58] Field of Search ..... 15/52, 98, 320, 322, 15/340.2, 230, 230.14, 230.16, 340.3, 340.4

[56] References Cited

U.S. PATENT DOCUMENTS

| | | | |
|---|---|---|---|
| 920,136 | 5/1909 | Henning | 15/52 |
| 990,775 | 4/1911 | Reid | 15/52 |
| 1,062,533 | 5/1913 | Brett | 15/52 |
| 2,165,331 | 7/1939 | Benish | 15/52 |
| 2,518,183 | 8/1950 | Renne | 15/52 |
| 4,369,544 | 1/1983 | Parisi | 15/320 |

FOREIGN PATENT DOCUMENTS

| | | | |
|---|---|---|---|
| 436286 | 10/1935 | United Kingdom | 15/52 |

*Primary Examiner*—Edward L. Roberts
*Attorney, Agent, or Firm*—Erik M. Arnhem

[57] ABSTRACT

A cleaning device for floors or walls, in which water or similar cleaning fluid is continuously applied to the work surface as the device moves along that surface. A power-driven rotary brush is located to exert a scrubbing action on the applied water film so as to assimilate dirt particles into the water film. The dirt-laden water is removed from the work surface by two power-driven rotary sponges located directly behind the rotary brush. A sponge compression structure is engaged with an upper surface of each sponge to continuously water absorbed by the sponges.

10 Claims, 5 Drawing Sheets

CLEANING DEVICE HAVING AT LEAST ONE ROTATING CYLINDRICAL SPONGE

BACKGROUND OF THE INVENTION

1. Field of the Invention

This invention relates to a cleaning device for cleaning floors or walls, said device including means for applying a film of water or other cleaning fluid to the work surface of a rotary brush for scrubbing the cleaning fluid on the work surface, and at least one rotary sponge for removing the dirt-laden fluid from the work surface.

2. Prior Developments

It is known that dirt can be removed from floors by pouring water onto the floor surface, scrubbing the water to transfer dirt into the water film, and removing the dirt-laden water with a sponge.

SUMMARY OF THE PRESENT INVENTION

The present invention is concerned with a device that facilitates the component processes of applying the water to the work surface, scrubbing the water-coated work surface, and removing the dirt-laden water from the work surface. The work surface may be a floor or a wall.

A preferred cleaning device embodying the invention comprises a manually-steerable housing supported by wheels above the work surface, an elongated nozzle means extending transversely across the housing for applying a film of water to the work surface, a rotary cylindrical brush located behind the nozzle for exerting a scrubbing action on the water-coated work surface, at least one rotary cylindrical sponge located behind the brush for removing dirt-laden water from the work surface, and a sponge compression means engageable with an upper surface of the sponge to remove the dirt-laden water from sponge, whereby the sponge remains in a condition for absorbing water from the work surface as the cleaning device is steered along the work surface.

The invention contemplates a hand-controlled cleaning device that can be operated continuously to perform a wet-cleaning operation on an entire floor without stopping to replenish the cleaning fluid supply or, to remove water from the sponge or similar water-absorption element.

THE DRAWINGS

DESCRIPTION OF A PREFERRED EMBODIMENT OF THE INVENTION

Figure 1:
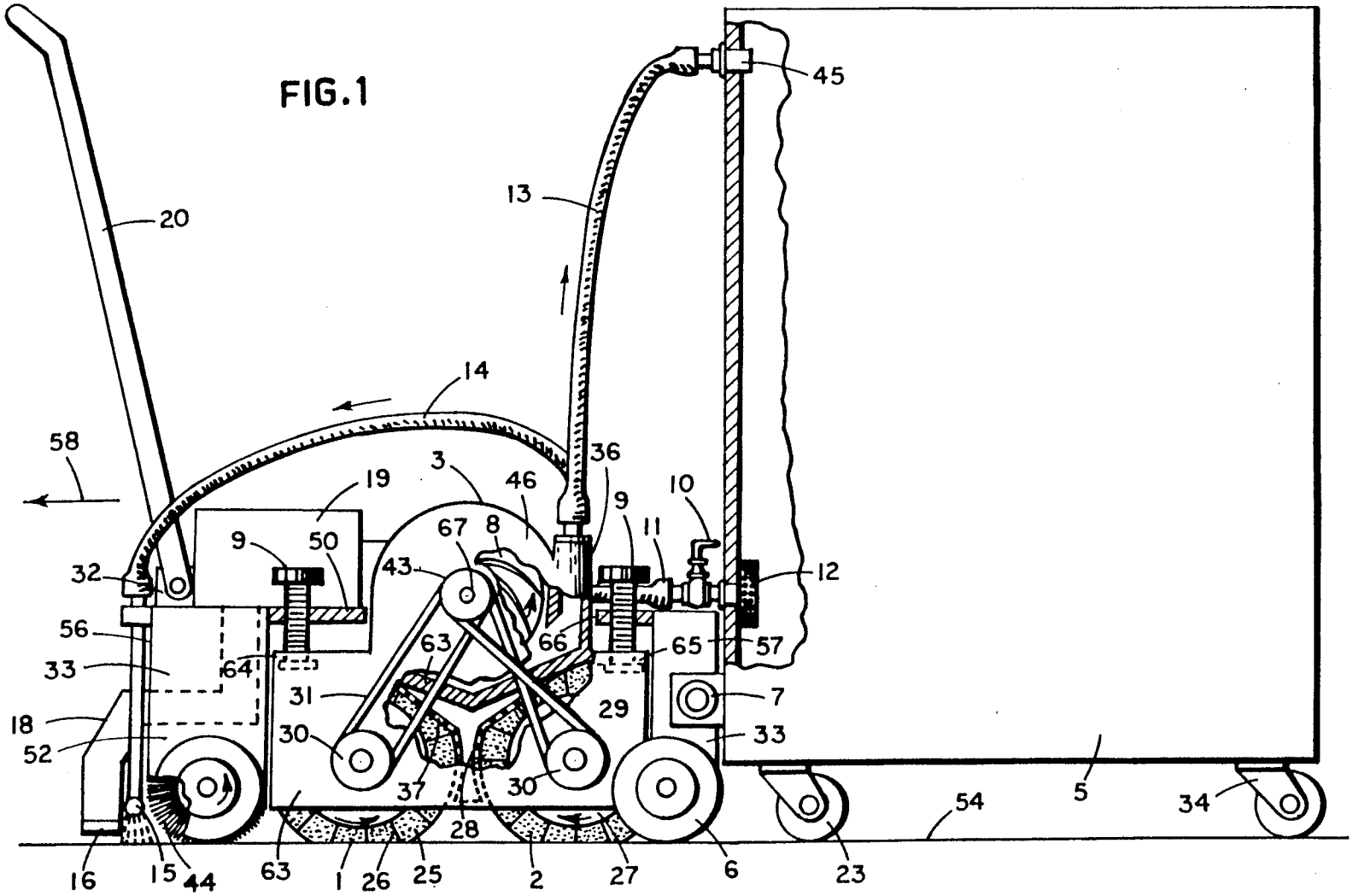
FIG. 1 is a side elevational view of a cleaning device constructed according to the invention, with parts thereof in section to show interior details.

The drawings show a manually manipulatable floor cleaning device that includes a housing 33 having an upper wall 50 and a downwardly-extending skirt 52.

The housing is supported above floor surface 54 by means of four non-powered wheels 6. Surface 54 is sometimes hereinafter as the work surface, since it is the surface that is to be cleaned by the cleaning device.

Housing 33 has a front end designated by numeral 56 and a rear end designated by numeral 57. A handle 20 is swingably attached to the front end of the housing, whereby a person can pull the housing along work surface 54 in the direction indicated generally by 58 (FIGS) 2 and 3). Numeral 58 can be considered as the housing movement axis. Attached to the rear end of housing 33 is an upstanding container or basin 5 for cleaning fluid. As shown in the drawing, the connection between the housing and container 5 comprises two laterally spaced connector pins 7. The cleaning fluid preferably comprises water that may have a minor quantity of detergent therein. Castered wheels 23 support the cleaning fluid container for movement along the work surface 54.

Figure 2:
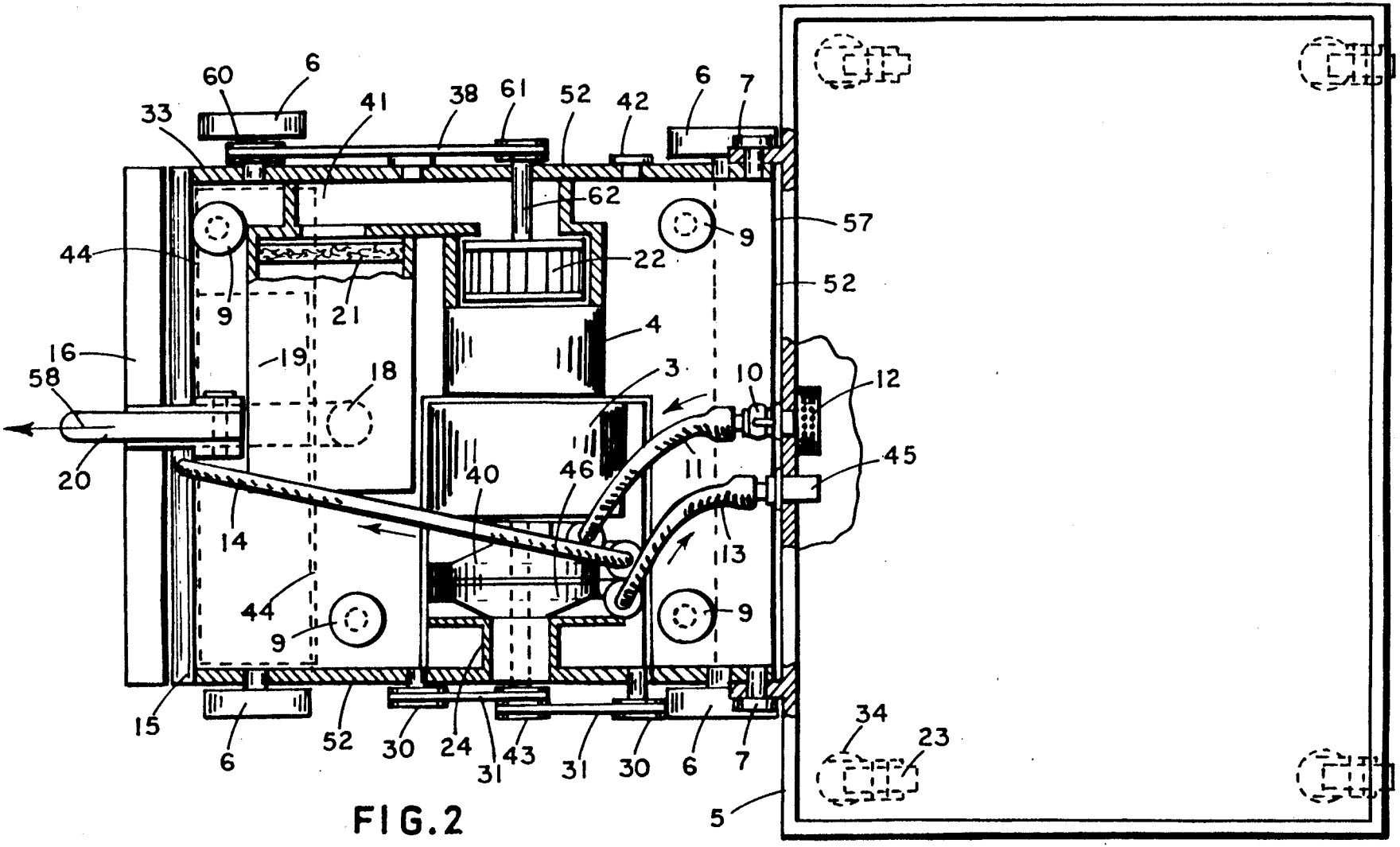
FIG. 2 is a top plan view of the FIG. 1 cleaning device, with parts thereof in section.
Figure 3:
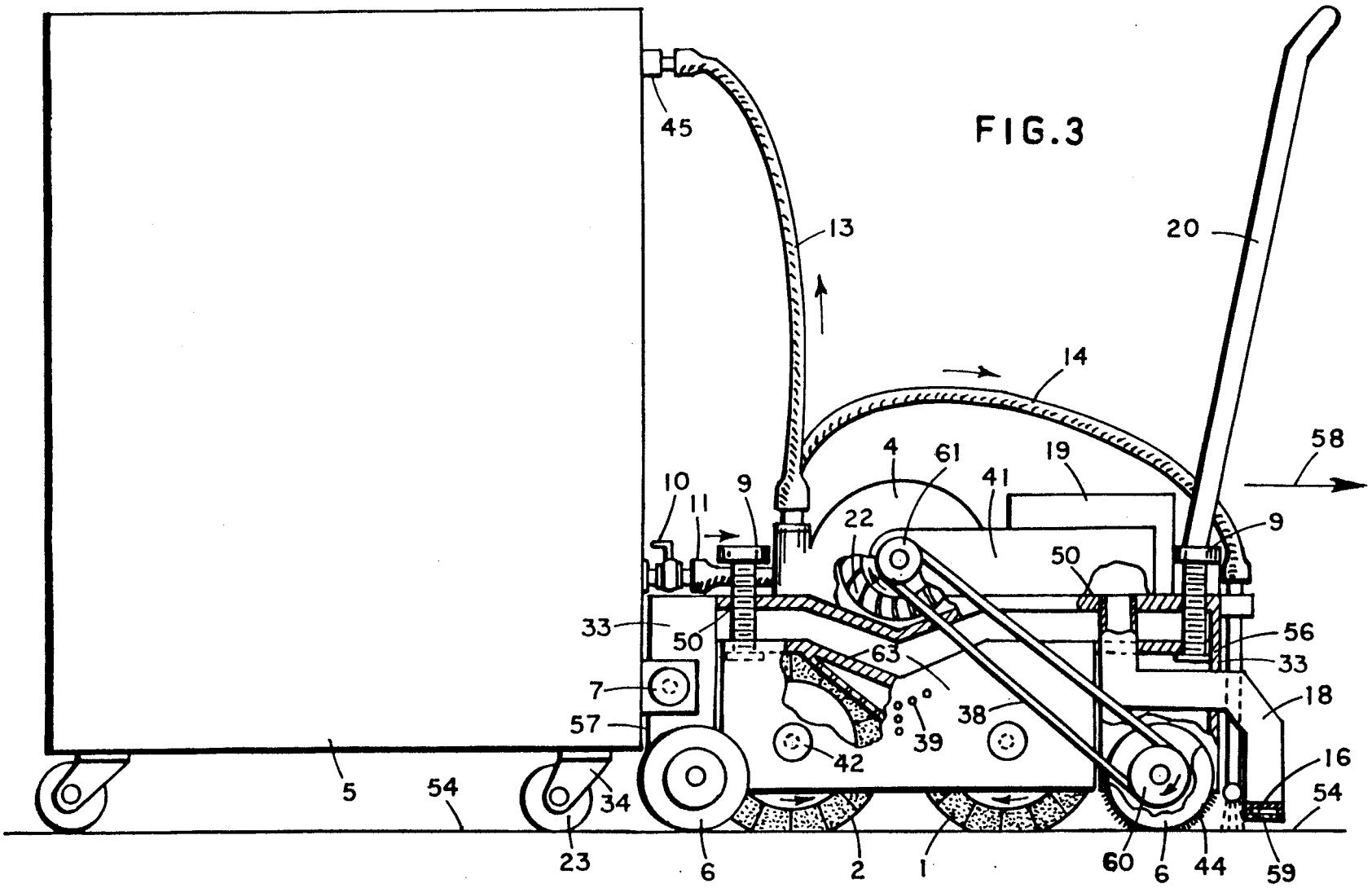
FIG. 3 is a side elevational view of the FIG. 1 cleaning device taken in an opposite direction from FIG. 1 parts of the device are shown in section.
Figure 5:
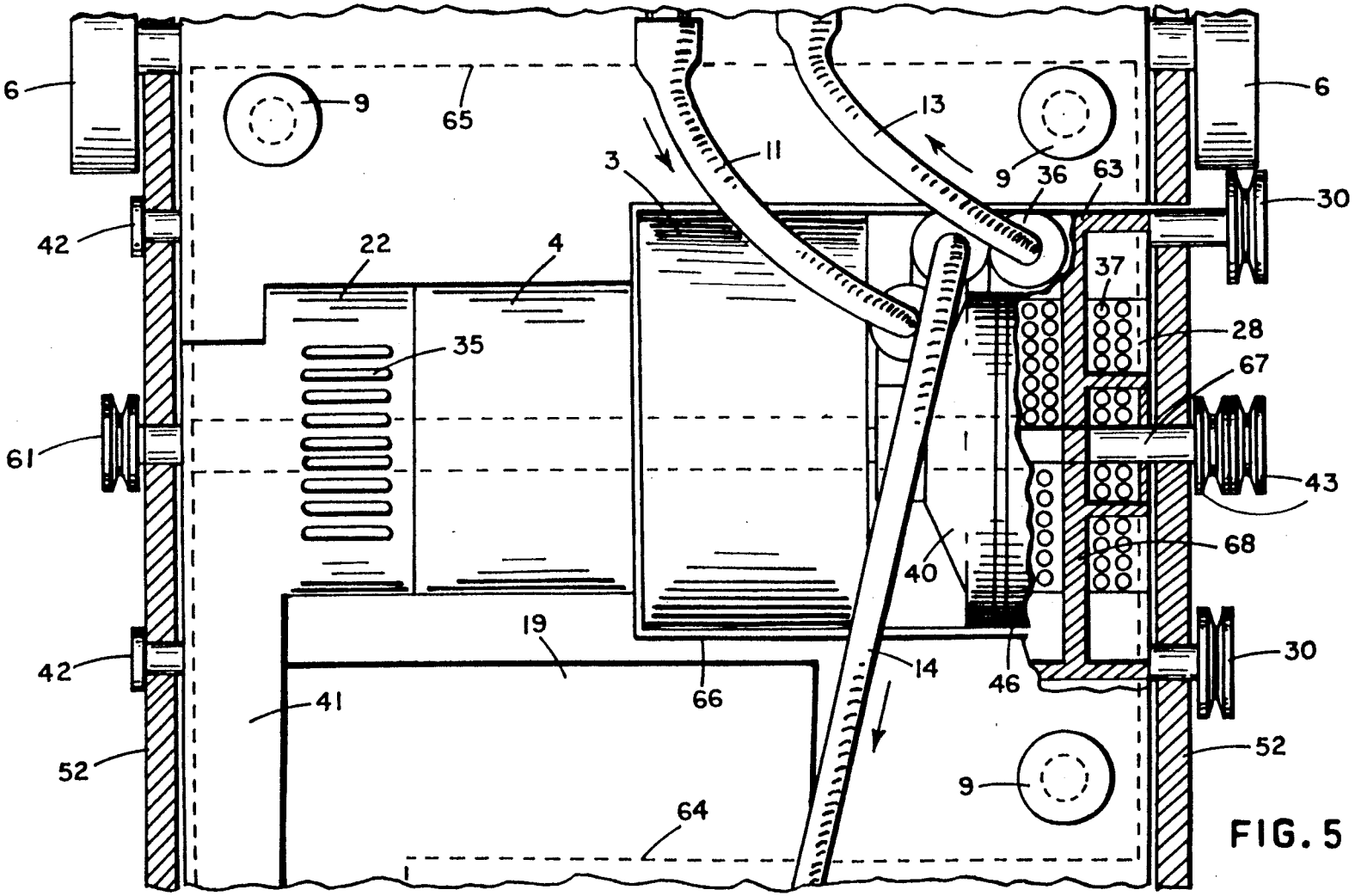
FIG. 5 is an enlarged fragmentary top plan view of the FIG. 1 cleaning device.

Extending transversely across the front end of housing 33 is a vacuum head 16. As seen in FIG. 3, head 16 has a slot 59 in its lower surface whereby the head is enabled to pick up loose dirt from floor surface 54; slot 54 extends the entire length of head 16. An S-shaped tube 18 extends upwardly from head 16 to communicate with a dirt collection chamber 19 located on housing upper wall 50. An upright filter panel 21 (FIG. 2) is located at one end of chamber 19 to trap dust particles from movement into a horizontal air duct 41, which communicates chamber 19 with a centrifugal fan 22. The fan is powered by an electric motor 4. As housing 33 moves over floor surface 54 loose dirt particles are drawn through head 16 and tube 18 for collection in chamber 19. The entraining air is drawn through duct 41 and fan 22 for exhaust through ventilation openings 35 (FIG. 5) in the fan housing wall.

Located directly behind vacuum head 16 is a transversely extending water nozzle 15. As seen in FIG. 2, the water nozzle is a horizontal tube extending the full transverse dimension of housing 33. The tube has a series of spaced ports in its lower surface, whereby water (cleaning fluid) can be discharged downwardly onto floor surface 54. The water is supplied by container 5 via a conduit 11, centrifugal water pump 40, and conduit 14. A manual shut-off valve 10 is provided in conduit 11. Also, a filter 12 is provided at the inlet end of conduit 11 to ensure that the water is in a clean condition when it is discharged from tubular nozzle 15. Pump 40 is powered by an electric motor 3.

Located behind water nozzle 15 is a cylindrical rotary brush 44 extending the full transverse dimension of housing 33. The brush has a support shaft journaled in the housing skirt wall 52; one end of the shaft carries a pulley 60 (FIG. 2) that is in mesh with a drive belt 38. The belt is trained around a second pulley 61 that is carried by the drive shaft 62 of motor 4. Thus, motor 4 serves as a drive means for fan 22 and rotary brush 44. However, in an alternate arrangement separate motors could be used to drive the fan and rotary brush. Use of separate motors enables the fan and brush to be operated at different speeds. If a single motor 4 is used the brush rotational speed can be reduced (as compared to the speed of fan 22) by selecting the relative diameters of pulleys 60 and 61. Brush 44 engages floor surface 54 to exert a scrubbing action on the fluid-coated surface, thereby assimilating dirt particles into the cleaning fluid. As previously noted, the cleaning fluid can be water, with or without a minor quantity of detergent therein.

A principal feature of the invention is a rotary sponge assembly comprised of two rotary cylindrical sponges 1 and 2 extending the full transverse dimension of housing 33. Each cylindrical sponge has a support shaft extending through the upstanding end walls of a rectangular sub-frame 63 (FIG. 1) that is located below housing wall 50. The sub-frame has a leading end edge 64 and a trailing end edge 65. Four screws 9 are rotably secured to the sub frame for adjustably suspending it from housing upper wall 50. Each screw 9 has a screw thread connection with a threaded opening in wall 50, whereby manual screw rotation can be used to raise or lower sub frame 63. The purpose of such an operation is to vary the surface pressure of the rotary sponges 1 and 2 on work surface 54. Also, by raising the sub frame a sufficient distance it is possible to lift the cylindrical sponges out of contact with the floor surface; such action makes it possible to use the cleaning device merely as a vacuum cleaner (without using water nozzle 15 or the sponges).

The cylindrical sponges 1 and 2 are powered in opposite directions by means of a horizontal axis electric motor 3 carried on sub frame 63. The motor housing extends upwardly through an opening 66 in housing upper wall 50. The motor shaft 67 mounts a centrifugal fan impeller located within a fan housing 8 that is mounted on sub frame 63 near one side edge of main housing 33. Shaft 67 extends beyond the fan housing through end wall 68 of the sub-frame and slot-like openings in the skirt wall 52 to support two pulleys 43.

The support shafts for sponges 1 and 2 are journaled in the upstanding end walls of sub frame 63. One end of each support shaft extends through a vertical slot in housing skirt 52 to mount an external pulley 30. Belts 31 are trained around pulleys 30 and pulleys 43, such that rotary drive forces are transmitted from motor shaft 67 to the sponge support shafts. The belts are arranged so that the two cylindrical sponges are driven in opposite directions.

Figure 4:
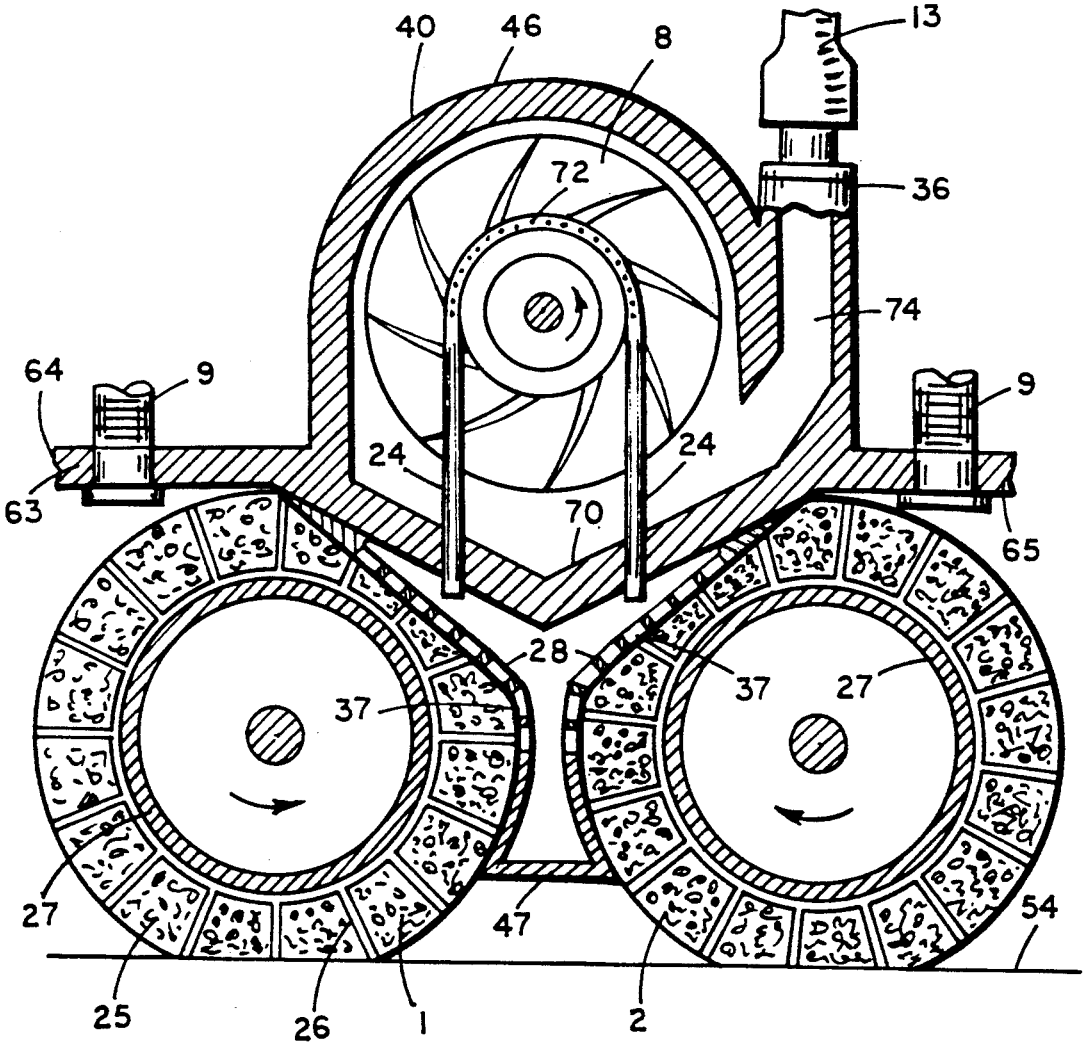
FIG. 4 is a fragmentary sectional view taken through a rotary sponge assembly used in the FIG. 1 cleaning device.

As shown in FIG. 4, each sponge 1 or 2 comprises a rigid cylinder 27 concentric with the sponge rotational axis, and a plurality of segmental sponge elements 25 radiating outwardly from the cylinder. Adjacent sponge elements are separated by a radial flexible partition 26, such that dirt-laden water absorbed by any given sponge element is prevented from migrating into adjacent sponge elements. Each partition 26 is formed of a flexible non-porous material. The partitions extend the full length of the rotary sponge. Preferably there are at least eight segmental sponge elements and partitions in each cylindrical sponge.

A sponge compression means is engageable with the upper surface area of each sponge 1 or 2 for removing dirt-laden fluid from the sponge while the sponge is rotating. As shown in FIG. 4, the sponge compression means comprises two perforated plates 28 arranged in a V-shaped orientation between the two sponges; the plates extend the full lengths of the cylindrical sponges. The two perforated plates are connected to form a collecting trough 47 for dirt laden water forced out of the sponges by the compressing action of plates 28. Upper end edges of plates 28 are connected by an overlying wall 70 that defines sub-frame 63. The space circumscribed by plates 28 and wall 70 is closed, except that air intake holes 39 (FIG. 3) are provided to prevent a vacuum condition that would tend to prevent flow of dirt-laden water out of trough 47.

Fan impeller 8 constitutes a suction means for drawing dirt-laden fluid out of collection chamber 47. A U-shaped tube 24 has lower open end portions extending downwardly into the collection chamber, and a series of port openings 72 communicating with the intake area of the impeller, so that when the impeller is rotating dirt-laden water is drawn upwardly through tube 24 for assimilation into the airstream generated by the impeller. The air-water mixture is forced through a pump (fan) discharge passage 74 into a hose 13 which leads into container 5. Hose 13 is fitted into connecting sleeves 36 and 45. The dirt-laden water absorbed by rotating sponges 1 and 2 is thus continuously removed from the sponges for disposition in container 5. A partition may be provided in container 5 to separate the dirt-laden water from the clean water being supplied to conduit 11. Alternately, the dirt-laden water can be comingled with the clean water; in the latter event the filter 12 can serve to maintain the water supplied to conduit 11 in a relatively clean condition.

It will be seen that motor 3 serves to power water pump 40 and centrifugal fan 8. The two impeller elements are arranged on opposite sides of a radial partition in a common housing for the two impellers. Motor 3 also serves as the means for rotating sponges 1 and 2. The sponges can be rotated at slower speeds than the impellers by selecting the relative diameters of pulleys 30 and 43. Alternately, a separate motor could be used to power the rotary sponges. The two sponges rotate at the same speed, but in opposite directions.

The sponge rotational speed is preferably greater than the movement speed of housing 33 over work surface 54 in order that the segmental sponge elements 25 can effectively absorb essentially all of the water lying on surface 54. Partitions 26 in each rotary sponge prevent the absorbed water from migrating gravitationally or (circumferentially) so as to overflow the sponge surface back onto work surface 54.

Because the two sponges rotate in opposite directions they tend to roll on surface 54 without undue drag action. Sponge 1 tends to pull the main housing 33 forwardly, whereas sponge 2 tends to pull housing 33 rearwardly; the opposing forces tend to largely cancel each other. If however, an undesired drag action is produced by the oppositely rotating sponges the sub-frame 33 can be raised slightly to reduce the contact area between the sponges and work surface 54. In a modified form of the invention a single rotary sponge can be used instead of the dual sponges.

The drawings show a cleaning device adapted for use on floors. By building the device to a smaller overall size it is possible to provide a wall-cleaning apparatus, in such case the swingable handle 20 would preferably be replaced by a smaller hand grip attached to a central portion of the cleaner device housing. Further, the container should be disconnected from the housing and the hose, fitted between the connecting sleeves of the container and housing, replaced by an extended one and another hose connected up between the conduit, being supplied with water from the container, and its shut-off valve.

It will be appreciated that the drawings are illustrative, and that the invention can be practiced in various different forms and configurations.

What is claimed is:

1. A device for cleaning a work surface, comprising a housing having a front end and a rear end; wheels carried by said housing for rollably supporting said housing said housing in spaced relation to the work surface; said housing having a movement axis parallel to the wheel movement planes; means for applying a film of cleaning fluid to the work surface as the housing moves therealong; an axially elongated rotary cylindrical brush carried by the housing for rotational motion around an axis transverse to the housing movement axis; said rotary brush being located behind the fluid applying means, whereby said brush exerts a scrubbing action on the fluid and work surface during movement of the housing; at least one rotary cylindrical sponge supported for rotational movement around an axis transverse to the housing movement axis; each said rotary sponge being located behind the rotary brush, whereby each said sponge removes cleaning fluid and loosened dirt from the work surface incident to movement of the housing along the work surface; sponge compression means engageable with an upper surface area of each said sponge to remove dirt-laden fluid from the sponge while the sponge is rotating; said sponge compression means comprising a perforated plate extending along the axial length of each said sponge, whereby the plate exerts a compressing action on the sponge, such that dirt-laden fluid is forced out of the sponge through the plate perforations; each said sponge comprising a rigid cylinder concentric with the sponge rotational axis, a plurality of segmental sponge elements radiating outwardly from said cylinder, and a plurality of flexible partitions extending outwardly from said cylinder between adjacent ones of said sponge elements, whereby fluid absorbed by any given sponge element is prevented from migrating into adjacent sponge elements.

2. The cleaning device of claim 1, wherein there are at least eight segmental sponge elements in each rotating sponge.

3. The cleaning device of claim 1, and further comprising means for rotatably powering each said cylindrical sponge around its rotational axis, whereby the surface speed of said sponge is greater than the housing movement speed.

4. The cleaning device of claim 3, wherein said sponge powering means comprises an electric motor, and a belt drive means from the motor to the sponge.

5. A device for cleaning a work surface, comprising a housing having a front end and a rear end; wheels carried by said housing for rollably supporting said housing in spaced relation to the work surface; said housing having a movement axis parallel to the wheel movement planes; means for applying a film cleaning fluid to the work surface as the housing moves therealong; an axially elongated rotary cylindrical brush carried by the housing for rotational motion around an axis transverse to the housing movement axis; said rotary brush being located behind the fluid applying means, whereby said brush exerts a scrubbing action on the fluid and work surface during movement of the housing; two rotary cylindrical sponges supported for rotational movement around spaced parallel axes extending transverse to the housing movement axis; said rotary sponges being located behind the rotary brush, whereby said sponges remove cleaning fluid and loosened dirt from the work surface incident to movement of the housing along the work surface; a sponge compression means engageable with an upper surface area of each said sponge to remove dirt-laden fluid from the sponge while the sponge is rotating; said sponge compression means comprising two perforated plates extending along the facing surfaces of the rotary sponges in the space therebetween, and a wall structure interconnecting said perforated plates to form a fluid collection chamber between the two rotary sponges; said plates being spaced from the respective sponge rotational axes by lesser distances than the individual sponge radii, such that each plate exerts a compressing action on the associated sponge to force dirt-laden fluid through the plate perforation into the fluid collection chamber; and a suction means for drawing the dirt-laden fluid out of said collection chamber while the housing is moving along the work surface.

6. The cleaning device of claim 5, wherein said perforated plates are arranged in a V-shaped orientation between the two sponges.

7. The cleaning device of claim 5, wherein each cylindrical sponge comprises a rigid cylinder concentric with the sponge rotational axis, a plurality of segmental sponge elements radiating outwardly from said cylinder, and a plurality of flexible partitions extending outwardly from said cylinder between adjacent ones of said segmental sponge elements, whereby fluid absrobed by any given sponge element is prevented from migrating into adjacent sponge elements.

8. The cleaning device of claim 7, and further comprising means for rotatably powering said cylindrical sponges so that said sponges rotate in opposite directions while the housing is moving along the work surface.

9. The cleaning device of claim 8, wherein said sponge powering means comprises an electric motor, a first belt drive means from the motor to one of the sponges, and a second belt drive means from the motor to the other sponge.

10. The cleaning device of claim 8, and further comprising sub-frame adjustable mounted in said housing for adjusting movements in a vertical direction; said cylindrical sponges and said sponge powering means being mounted on said sub-frame so that the sponges can be raised or lowered relative to the work surface by vertical adjusting movements of the sub-frame.

* * * * *